US007918026B2

(12) United States Patent
Heglund et al.

(10) Patent No.: US 7,918,026 B2
(45) Date of Patent: Apr. 5, 2011

(54) METHOD FOR PRODUCTION OF A MAST SHAPED BODY

(75) Inventors: Kim Heglund, Nesøya (NO); Johnny Skǒld, Arvika (SE)

(73) Assignee: Juralco A/S, Rud (NO)

( * ) Notice: Subject to any disclaimer, the term of this patent is extended or adjusted under 35 U.S.C. 154(b) by 1165 days.

(21) Appl. No.: 10/581,018

(22) PCT Filed: Nov. 29, 2004

(86) PCT No.: PCT/NO2004/000366

§ 371 (c)(1),
(2), (4) Date: Oct. 26, 2006

(87) PCT Pub. No.: WO2005/054581

PCT Pub. Date: Jun. 16, 2005

(65) Prior Publication Data

US 2007/0125920 A1 Jun. 7, 2007

(30) Foreign Application Priority Data

Dec. 1, 2003 (NO) ..... 20035336

(51) Int. Cl.
*B21D 47/00* (2006.01)

(52) U.S. Cl. ..... 29/897.31; 29/897.33; 29/505; 29/524; 248/219.3

(58) Field of Classification Search ..... 29/897.31, 29/897.33, 505, 524; 52/651.07; 248/219.3, 248/225.11, 225.21

See application file for complete search history.

(56) References Cited

U.S. PATENT DOCUMENTS

| | | | | |
|---|---|---|---|---|
| 674,379 | A | 5/1901 | Hard | |
| 742,549 | A | 10/1903 | Zeh et al. | |
| 3,861,339 | A | 1/1975 | Aida et al. | |
| 4,580,380 | A | 4/1986 | Ballard | |
| 5,671,522 | A * | 9/1997 | Aronne | 29/419.2 |
| 6,296,287 | B1 | 10/2001 | Kinbara et al. | |

FOREIGN PATENT DOCUMENTS

| | | | |
|---|---|---|---|
| JP | 59179284 | A | 10/1984 |
| JP | 2000051958 | A | 2/2000 |
| NO | 309109 | B1 | 12/2000 |
| WO | WO 01/36750 | A1 | 5/2001 |

* cited by examiner

*Primary Examiner* — David P Bryant
*Assistant Examiner* — Ryan J Walters
(74) *Attorney, Agent, or Firm* — Cohen Pontani Lieberman & Pavane LLP

(57) ABSTRACT

A method for production of masts with extruded bodies includes joining at least three mast elements at corners of the mast by cooperating rail sections and channel sections. The channel sections are provided with tapered inner wall sections. The mast elements are joined by inserting the rail section of one mast element into a channel section of an adjacent mast element and clamping the rail section in the channel section. The clamping is accomplished moving a roller in a longitudinal direction on the external sides of the channel section and causing permanent deformation of the walls of the channel section around the rail section to establish a permanently joined corner.

16 Claims, 3 Drawing Sheets

METHOD FOR PRODUCTION OF A MAST SHAPED BODY

CROSS REFERENCE TO RELATED APPLICATION

This is the U.S. national stage of Application Serial No. PCT/NO2004/000366 filed 29 Nov. 2004. Priority is claimed on the following application: Country: Norway, Application No.: 20035336, Filed: Dec. 1, 2003.

The present invention relates to a method for production of masts mainly made up of extruded, assembled mast elements and having a general cross section area comprising at least three mast elements joined at the corners by means of co-acting rail sections and channel sections. Also, the invention relates to an embodiment of the co-acting rail sections and channel sections.

Masts of this type may for example be masts intended for traffic information or lightening, such as traffic signs, light signals, full- or half gantries, street lightening, airport lightening, or similar. Such masts must both yield when exposed to collision forces and having energy absorbing properties in case of collision or other types of heavy, mechanical impacts.

Masts of this type are, dependent of required shape, formed of three or more similar extruded aluminium elements, assembled together forming the mast. The connection between two adjoining aluminium elements is obtained by means of a friction joint or cladding joint.

It has previously been proposed, for example from WO 01/36750 A1, to provide one side edge of an aluminium element with a channel section and the opposite side edge with an rail section, wherein two profile elements are joined together by forcing the wedge section of one element into the channel section of the other element and thereafter pressing the channel sections around and into frictional contact with the wedge section.

According to the prior art solutions such way of establishing a joint between to aluminium elements are both a time consuming and expensive method for joining two aluminium elements.

The objective of the present invention is to simplify this joining process and to secure a better connection between the aluminium elements, i.e. at the corners of the mast, and to arrange for a more automatic and controlled production. At the same time it is also an objective to ensure that the joined corner areas of the mast are not detrimentally reduced and that the connection still has the required strength, both locally and globally, thus ensuring that the new solution does not affect the basis for technical type approval to be given by the authorities for such type of masts.

The above defined objectives are met by means of a joining method as further described in claim 1 and the corresponding dependent claims.

According to the invention it is feasible to produce in a continuous manner a joint having great strength and an even joint quality along the entire length of the joint. The solution according to the invention render it possible to obtain a mechanical joint in suitable premises and in controlled manner, resulting in increased production rates, high and even quality and in a cost effective production.

According to the invention a repeated precision in the joint is achieved, making it possible to reduce the material factor to be met in accordance with applicable standards used for designing and engineering of the mast elements.

The invention will be described in detail below, referring to the appended drawings, in which:

FIG. 1 shows a traffic sign 13, supported by three masts 14. It should be appreciated that the invention is not limited to be used in connection with masts for supporting of signs, but may be used for various purposes in connection with any masts or the like, such as masts placed along roads, airports or the like.

Figure 2:
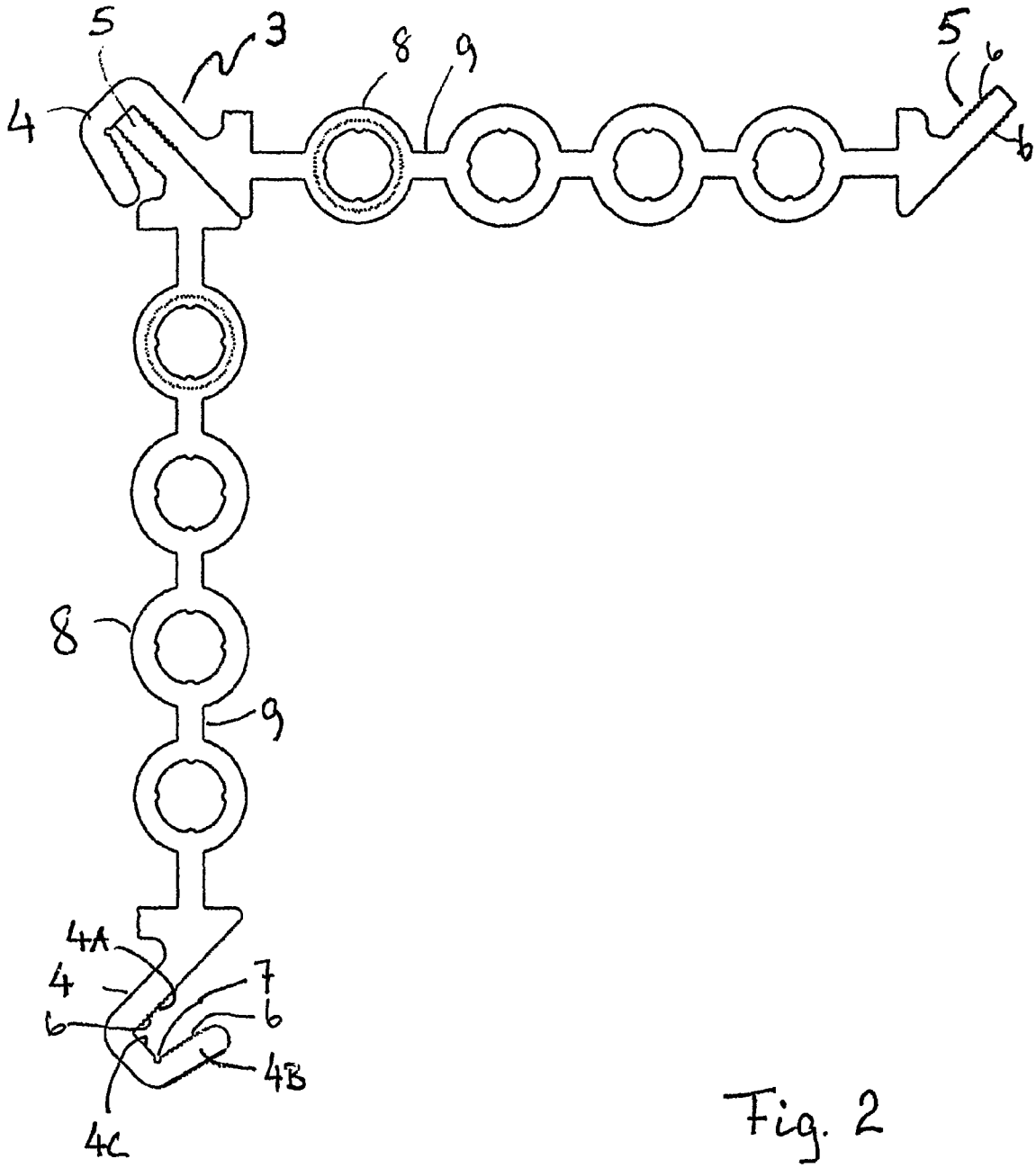
FIG. 2 shows two aluminium profiles joined together in order to form two of the sides of a four element mast prior to possible rolling operations.

FIG. 2 shows elements of a partly assembled four sided mast, the drawing showing two aluminium profiles 1,2 assembled, prior to clamp rolling of the joined corner 3. As shown in FIG. 2 each aluminium profile 1,2 is along one longitudinal edge provided with a channel section 4, while the profile along the opposite longitudinal edge is provided with a rail section 5. The rail section 5 is designed to be inserted into the channel section 4 on adjoining aluminium profile 1,2, the two sections forming together a corner 3. The channel section 4 and the rail section 5 are clamped together by means of a roller tool (not shown), pressing said two sections 4,5 together to form a clamped corner 3.

As shown in FIG. 2 the channel section 4 is, prior to connection and rolling, provided with a tapered inner wall portions 4A,4B, the two tapered wall sections 4A,4B being spaced apart by means of bottom portion 4C. Both the wall portion 4A and the wall portion 4B are equipped with indents, grooves or protruding edges 6, at least along parts of opposite wall portions 4A,4B on opposing, inner wall surfaces.

Correspondingly each aluminium element is along its opposite edge equipped with a longitudinal rail section 5 intended to be inserted into the channel section 4 and clamped. Further, the rail section 5 may, preferably on both sides, be equipped with teeth, ridges or rifles 6 at least along parts in the longitudinal direction of the profile and preferably along the areas of the channel section 4 which are equipped with corresponding teeth, rifles or ridges 6.

The purpose of the rifles, teeth or ridges 6 is to obtain an improved locking effect of two aluminium elements 1,2 upon completed rolling process.

As further shown in FIG. 2, the channel section 4 between the outer channel wall 4B and the intermediate section 4C, is provided with a notch 7. Said notch 7 is dimensioned and formed in such way that no or a minimum of swage or upset of metal occur when forming the corner joint 3, i.e. the channel section 4 and the rail section 5.

The intermediate bottom section 4C of the channel section 4 is wider than the width of a corresponding rail section 5, whereby the rail section 5 in an easy manner, without complications and without applying force, may be inserted into the channel section when connecting two aluminium profiles 1,2.

Figure 3:
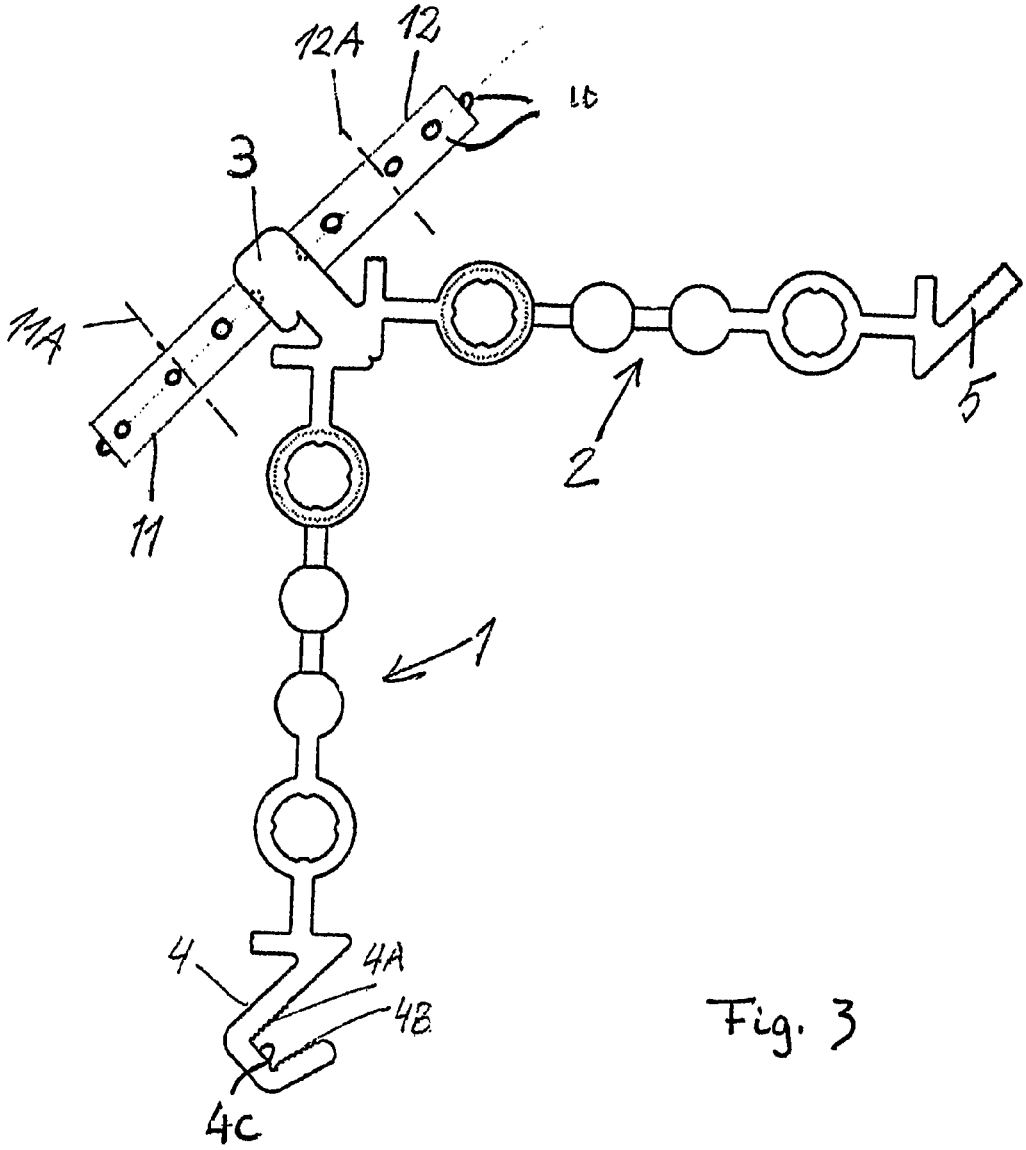
FIG. 3 shows corresponding aluminium profiles subsequent to a completed rolling operation, the Figure also showing the rollers on a roller tool forming the rolled connection between two aluminium corners.

FIG. 3 shows a corresponding section as shown in FIG. 2. As indicated in FIG. 3, the corners are rolled to form a joint by means of two rollers or wheels 11,12, rotatably arranged on two parallel axes 11A,12A. The rolling tool is further equipped with means (not shown) for regulating the exerted contact pressure between the wheels or the rollers 11,12 and the joint of the corner to the corner 3 to be joined, in order to obtain necessary bonding between the elements forming the corner 3.

Figure 1:
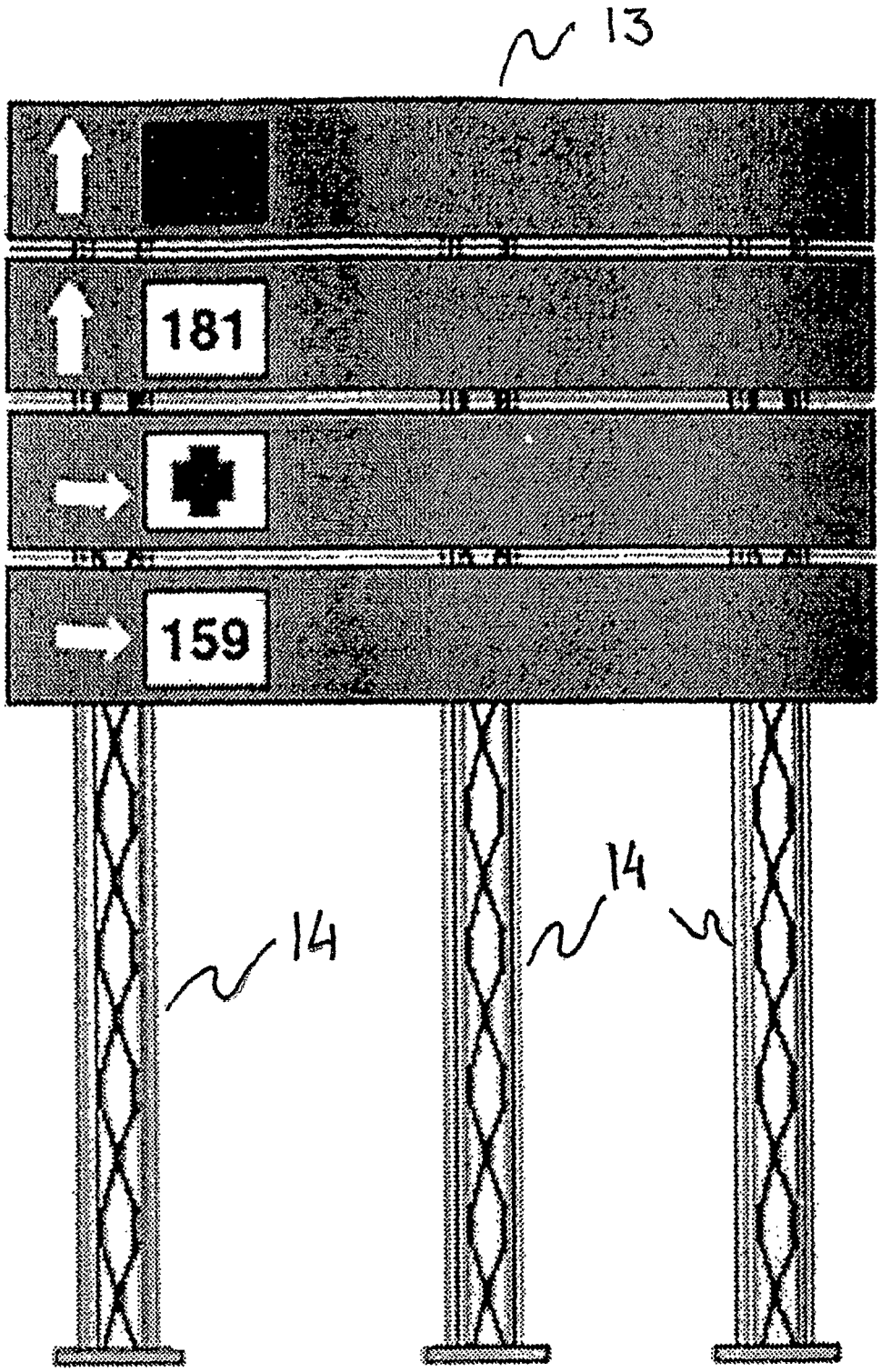
FIG. 1 shows a sign supported by three masts according to the present invention.
Figure 4:
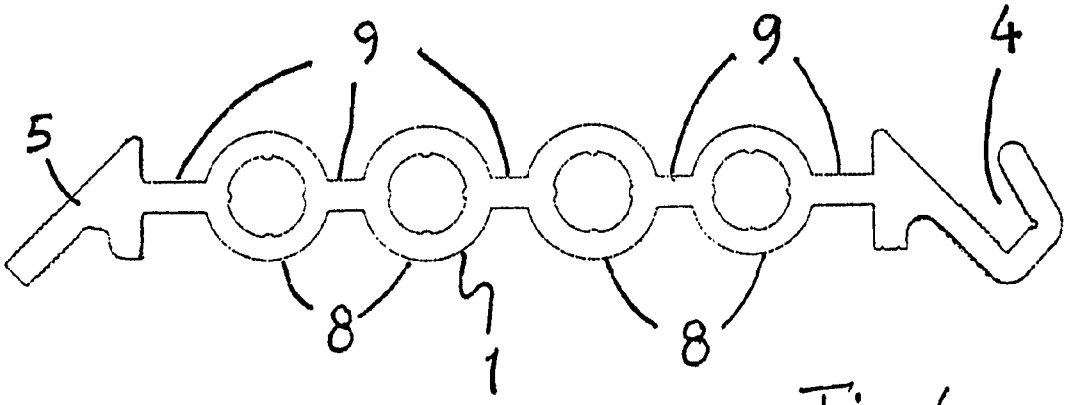
FIG. 4 shows a section through an aluminium profile prior to formation of a mast profile of the type shown in FIG. 1.

FIG. 4 shows a section through an aluminium profile 1 prior to converting the profile to a mast profile of the type shown on FIG. 1. As previously described in connection with FIGS. 2 and 3, the aluminium profile 1 is at one side of the profile, provided with a channel section 4 according to the invention and at the opposite side of the profile provided with a rail section 5 according to the invention. According to the embodiment shown in FIG. 4, an intermediate section of the aluminium profile 1, is formed by four parallel tubular profiles 8 in the form of cylindrical tube elements. Each tubular profile 8 is connected to the adjacent profile 8 and/or channel section 4 or the rail section 5 by means of an intermediate section 9.

When producing an aluminium profile with such configuration as shown in FIG. 1, a profile is firstly extruded, the profile having a cross section area and shape as shown in FIG. 4. In this initial phase the channel section 4, the rail section 5, the tubular profile 8 and the intermediate parts 9 extend in parallel along the entire longitudinal direction of the aluminium profile. During the extrusion process or in a subsequent process, longitudinal slits, at last in the two middle tubular profiles 8 are made on one and/or the opposite sides, whereupon the aluminium profile is stretched in lateral direction with respect to its longitudinal direction. In such manner a zigzag pattern as indicated in FIG. 1 is obtained.

The invention is not limited to masts assembled by three or four aluminium profiles. Further, it should be appreciated that the invention is not limited to elements formed of aluminium. Other types of metal having corresponding strength and inherent properties, suitable for being rolled may also be used without deviating from the inventive idea. It should further be appreciated that that the design and configuration of the profile may also be different from the configurations shown in the Figures.

The invention claimed is:

1. A method for production of a mast comprising at least three identical extruded mast elements having opposing side edges, the mast elements are interconnected along the side edges at corners of the mast, each of the mast elements having a straight elongated channel section along one of the side edges and a straight elongated rail section along the opposing one of the side edges, the rail section of one of the mast elements being inserted into the channel section of an adjacent one of the mast elements for establishing a joint between the one of the mast elements and the adjacent one of the mast elements, wherein the method comprises:

providing the channel section with inwardly tapered inner wall sections formed during the extrusion process of forming the extruded mast elements, an inner distance between the inner wall sections at a bottom end of the channel section is equal to or larger than a width of the rail section;

inserting at least a part of the rail section of the one of the mast elements into the channel section on the adjacent one of the mast elements; and moving, in a substantially continuous motion, a roller type tool in longitudinal direction of and on the exterior of the channel section, the roller type tool having rollers arranged on opposing sides of the channel section, the rollers having outwardly projecting knobs to be pressed onto the joint, the rollers providing sufficient force to clamp the channel section and the rail section together, causing permanent deformation of the channel section around the rail section, and forming one of the corners of the mast, wherein the knobs form spot strengthened areas on both opposing sides of the joint.

2. The method according to claim 1, wherein the at least a part of the rail section intended to be inserted in the channel section on an adjacent mast element is provided with teeth, ridges or rifles at least along parts of a length of the mast elements, said teeth, ridges or rifles being at least partly deformed in order to obtain a secure joint between the channel section and the rail section when the roller type tool clamps the channel section and the rail section.

3. The method according to claim 2, wherein at least one of the inner wall sections of the channel section is provided with teeth, ridges or rifles, said teeth, ridges or rifles being at least partly deformed to form a secure joint when the roller type tool forces the walls of the channel section into gripping contact with the rail section.

4. The method according to claim 2, wherein the inner wall sections of the channel is section are tapered with respect to one another in order to simplify insertion of the rail section into the channel section, whereupon the tapered inner wall sections on the channel section are forced against the rail section by the roller type tool.

5. The method according to claim 2, wherein a transition between the one of the inner wall sections of the channel section along its inner surface on the lower part of the one of the inner wall sections is provided with an inner recess in order to secure a proper joint between the channel section and the rail section.

6. The method claim 2, wherein each of the mast elements comprises a plurality of interconnected tubular profiles interconnected with intermediate plates, the tubular profiles during the extrusion process or subsequent to the extrusion process being provided with intermittent slits on one or both side of the tubular profile, whereupon each of the mast elements are stretched in a lateral direction with respect to the longitudinal direction of the elements thereby forming a lattice element.

7. The method according to claim 1, wherein at least one of the inner wall sections of the channel section is provided with teeth, ridges or rifles, said teeth, ridges or rifles being at least partly deformed to form a secure joint when the roller type tool forces the walls of the channel section into gripping contact with the rail section.

8. The method according to claim 7, wherein the inner wall sections of the channel section are tapered with respect to one another in order to simplify insertion of the rail section into the channel section, whereupon the tapered inner wall sections on the channel section are forced against the rail section by the roller type tool.

9. The method according to claim 7, wherein a transition between the one of the inner wall sections of the channel section along its inner surface on the lower part of the wall one of the inner wall sections is provided with an inner recess in order to secure a proper joint between the channel section and the rail section.

10. The method according claim 7, wherein each of the mast elements comprises a plurality of interconnected tubular profiles interconnected with intermediate plates, the tubular profiles during the extrusion process or subsequent to the extrusion process being provided with intermittent slits on one or both side of the tubular profile, whereupon each of the mast elements are stretched in a lateral direction with respect to the longitudinal direction of the elements thereby forming a lattice element.

11. The method according to claim 1, wherein the inner wall sections of the channel section are tapered with respect to one another in order to simplify insertion of the rail section into the channel section, whereupon the tapered inner wall sections on the channel section are forced against the rail section by the roller type tool.

12. The method according to claim 11, wherein a transition between the one of the inner wall sections of the channel section along its inner surface on the lower part of the one of the inner wall sections is provided with an inner recess in order to secure a proper joint between the channel section and the rail section.

13. The method according claim 11, wherein each of the mast elements comprises a plurality of interconnected tubular profiles interconnected with intermediate plates, the tubular profiles during the extrusion process or subsequent to the extrusion process being provided with intermittent slits on one or both side of the tubular profile, whereupon each of the mast elements are stretched in a lateral direction with respect to the longitudinal direction of the elements thereby forming a lattice element.

14. The method according to claim 1, wherein a transition between the one of the inner wall sections of the channel section along its inner surface on the lower part of the one of the inner wall sections is provided with an inner recess in order to secure a proper joint between the channel section and the rail section.

15. The method according claim 14, wherein the each of the mast elements comprises a plurality of interconnected tubular profiles interconnected with intermediate plates, the tubular profiles during the extrusion process or subsequent to the extrusion process being provided with intermittent slits on one or both side of the tubular profile, whereupon the each of the mast elements are stretched in a lateral direction with respect to the longitudinal direction of the elements thereby forming a lattice element.

16. The method according to claim 1, wherein each of the mast elements comprises a plurality of interconnected tubular profiles interconnected with intermediate plates, the tubular profiles during the extrusion process or subsequent to the extrusion process being provided with intermittent slits on one or both side of the tubular profile, whereupon each of the mast elements are stretched in a lateral direction with respect to the longitudinal direction of the elements thereby forming a lattice element.

* * * * *